US006893050B2

(12) United States Patent
Schiemann et al.

(10) Patent No.: US 6,893,050 B2
(45) Date of Patent: May 17, 2005

(54) PLUG-IN VACUUM CLEANER HOSE ARRANGEMENT

(75) Inventors: Jürgen Schiemann, Ense-Höingen (DE); Hartmut Kiel, Sundern (DE)

(73) Assignee: Froh House Tech GmbH & Co. KG, Sundern (DE)

( * ) Notice: Subject to any disclaimer, the term of this patent is extended or adjusted under 35 U.S.C. 154(b) by 0 days.

(21) Appl. No.: 10/070,019

(22) PCT Filed: Jun. 26, 2001

(86) PCT No.: PCT/DE01/02300

§ 371 (c)(1),
(2), (4) Date: Apr. 3, 2002

(87) PCT Pub. No.: WO02/00087

PCT Pub. Date: Jan. 3, 2002

(65) Prior Publication Data

US 2002/0135183 A1 Sep. 26, 2002

(30) Foreign Application Priority Data

Jun. 27, 2000 (DE) ..... 100 30 304

(51) Int. Cl.[7] ..... A47L 9/24; F16L 27/12

(52) U.S. Cl. ..... 285/7; 285/86; 285/302; 285/316; 285/319; 285/921

(58) Field of Search ..... 285/7, 302, 303, 285/903, 319, 86, 921, 314, 316

(56) References Cited

U.S. PATENT DOCUMENTS

| | | | | |
|---|---|---|---|---|
| 3,351,363 A | | 11/1967 | Downey et al. | |
| 4,681,350 A | * | 7/1987 | Gaita | 285/315 |
| 5,116,086 A | * | 5/1992 | Psajd | 285/277 |
| 5,954,370 A | | 9/1999 | Pietersen | |
| 6,237,962 B1 | * | 5/2001 | Lim | 285/7 |
| 6,494,492 B1 | * | 12/2002 | Ha | 285/7 |

FOREIGN PATENT DOCUMENTS

| | | | |
|---|---|---|---|
| DE | 1 450 445 | 3/1969 | |
| DE | 39 31 639 | 4/1991 | |
| DE | 42 00 527 | 7/1993 | |
| DE | 43 03 596 | 8/1994 | |
| DE | 197 38 194 | 6/1998 | |
| DE | 19706210 A1 * | 8/1998 | A47L/9/00 |
| DE | WO 00/08997 | 2/2000 | |
| GB | 2 329 944 | 4/1999 | |
| JP | 09206252 | 8/1997 | |
| WO | WO 97/12168 | 4/1997 | |

* cited by examiner

*Primary Examiner*—David Bagnell
*Assistant Examiner*—G M Collins
(74) *Attorney, Agent, or Firm*—Herbert Dubno

(57) ABSTRACT

The invention relates to a plug-in vacuum cleaner hose arrangement (10), comprising a socket (15), formed from a collar piece (12), in which a hose push-fit end (13) is detachably held, by axially plugging in to a clip-lock. An operating slide (17), comprising a retaining surface (26) runs axially on the collar piece (12) and may be axially displaced in both opposing axial directions (e, a) about a neutral axial position for the retaining surface (26) thereof, against a spring force (by 18). In said neutral axial position the retaining surface (26) locks the clip body (S) and releases the same when displaced from the neutral position thereof by any movement. The connection is produced by a first directing surface (41) on the front end of the hose push-fit end (13) and opening the connection is performed by a second directing surface (43) formed by the locking recess (T) of the hose push-fit end (14). Said arrangement (10) permits a convenient operation, both on attaching and detaching the connection.

10 Claims, 2 Drawing Sheets

PLUG-IN VACUUM CLEANER HOSE ARRANGEMENT

CROSS REFERENCE TO TED APPLICATIONS

This application is a national stage of PCT/DE 01/02300 filed 26 Jun. 2001 and is based upon German national application 100 30 304.8 of 27 Jun. 2000 under the International Convention.

FIELD OF THE INVENTION

The invention relates to a plug-in vacuum cleaner hose arrangement which can serve for releasable connection of two air-guiding hose parts.

BACKGROUND OF THE INVENTION

With a plug-in vacuum cleaner hose arrangement, a tubular transition can be provided to the vacuum tool such as a suction nozzle, a suction brush or the like. On the other hand, such a plug-in vacuum cleaner hose arrangement can also serve for example to connect a hand-grip arranged on a vacuum hose to the pipe insertion end of a telescoping pipe arrangement in a releasable manner.

The plug-in vacuum cleaner hose arrangement can be articulated on a sleeve part of a rocker, one end of which is spring-loaded in a locking direction and carries a radially inwardly projecting catch body which traverses the sleeve part and engages in a windmill configured as a detent recess of the tube insertion end or engages through the detent cutout. The other end of the rocker is configured as an actuating button.

The aforedescribed known plug-in vacuum cleaner hose arrangement is widely used in practice and has also been found to be satisfactory. However it is desirable to make the handling of the plug-in connection more comfortable upon assembly and release.

OBJECT OF THE INVENTION

It is an object of the invention to develop the arrangement further that both the assembly and release of the plug connection are substantially more convenient to manipulate than hitherto.

SUMMARY OF THE INVENTION

In accordance with the invention this object is achieved in that on the sleeve part, an actuating slide which is axially shiftable is provided and has a locking surface which in both mutually opposite axial directions starting from a neutral axial position, is displaceable against a restoring spring force which holds the locking surface in its neutral axial position which is the locking position. The slider is shiftable out of the neutral position into unlocking directions to free the locking or retaining surface. The front end of the hose insertion end has a first control or directing surface which upon insertion of the hose insertion end into the socket, entrains the sleeve part relative to the retaining surface in the hose-insertion direction, thereby unlocking the clip body and freeing it from its releasable snap engagement into the detent recess. A second directing surface is juxtaposed with the detent body which, upon withdrawal of the hose insertion end from the socket, moves the catch body with the sleeve part relative to the retaining surface in the withdrawal direction and thus detaches.

The arrangement according to the invention thus enables the following advantageous manipulation:

For assembly of the plug-in connection, one need only grip the socket part at its axially movable actuating slider with one hand of the operator and hold it and insert the plug-in end of the hose with the other hand of the user in the insertion direction into the socket.

Without requiring an additional manipulation by the user, the first control surface or directing surface of the plug-in end of the hose engages against the detent body or cliff body in its locking position and moves it together with the sleeve part in the axial direction away from the actuating slide. As a result, the blocking surface of the actuating slide liberates the locking body, whereupon the locking body can snap into the locking recess.

The locking of the catch body results automatically in that the release of the actuating slider by the hand of the user allows the restoring spring force which is effective in both axial directions to return the actuating body into its neutral axial position in which its blocking surface is returned to the blocking position for the catch.

When, on the other hand, the plug-in connection is to be released, it suffices for the arrangement to be engaged at the actuating slider with one hand of the operator while with the other hand of the operator the plug-in end of the hose is withdrawn from the socket. Thereupon the second control or directing surface engages the catch body and moves it together with the sleeve portion in the withdrawal direction relative to the locking surface and simultaneously disengages the detent body.

In a further feature of the invention the actuating slider forms a locking projection extending inwardly radially to the outer surface of the socket part and which is provided with the locking surfaces.

In the formation of the locking projection, the invention provides that it tapers somewhat radially to the socket part and is formed with a substantially frustopyramidal cross section, whereby the roof surfaces of the locking projection form the locking surfaces and slide surfaces which are inclined in opposite axial directions as lateral flanks for the locking body.

According to the invention, the spring restoring force which is effective in opposite directions is obtained in that the actuating slider has a somewhat radially inwardly projecting, substantially claw-like formation turned toward the socket part; the claw opening of this formation engages a bar spring slide on the socket part and which can be deflected in both opposite axial directions within the spring range.

The plug-in vacuum cleaner arrangement according to the invention simplifies manipulation and can be optimized finally in that the actuating slider is formed as an actuating sleeve on the socket part surrounding the latter over its entire circumferential length.

It has been found to be advantageous further in accordance with the invention, but not essential, that the end face of the plug-in end of the hose is conically convergent to form the first control or directing surface, over at least a part of its periphery. Basically the arrangement according to the invention will also function when the end face is invariably cylindrically configured and the thus formed end face provides the first control or directing surface.

Another advantageous feature of the invention, which results in a facilitated functioning upon assembly and release of the connection resides in that the catch recess or detent recess of the plug-in end of the hose is configured as a somewhat radially inwardly projecting (toward the hose center) cup-shaped depression, whereby the cup-shaped depression advantageously has a somewhat frustoconical cross sectional contour.

Finally, the cup-shaped detent recess formed with its lateral surfaces neighboring the end of the plug-in hose end simultaneously form the two control or directing surfaces.

BRIEF DESCRIPTION OF THE DRAWING

In the drawing an advantageous embodiment corresponding to the invention has been illustrated. The drawing shows.

SPECIFIC DESCRIPTION

Figure 1:
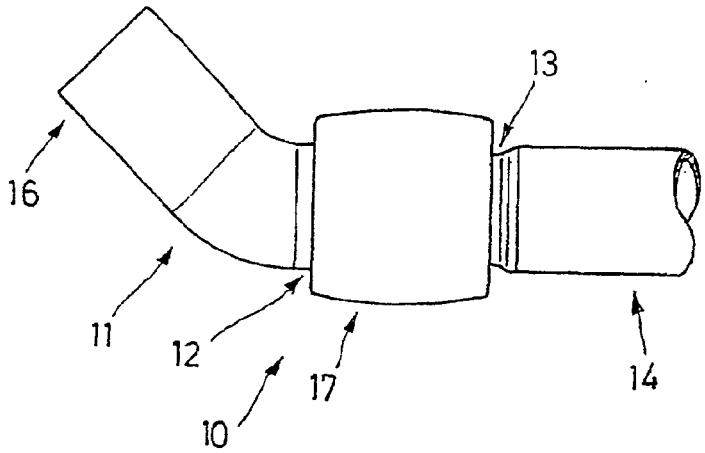
FIG. 1 a plug-in vacuum cleaner hose arrangement in an elevational view formed by a tubular nozzle connecting part of a plug-in hose end, for example, of a telescoping hose, FIG. 2 the arrangement according to FIG. 1 in an enlarged axial section by comparison to FIG. 1, FIG. 3 the connecting region according to FIG. 2 further enlarged, and FIG. 4 an enlarged detail somewhat corresponding to the region encircled at D in dot-dash lines.
Figure 2:
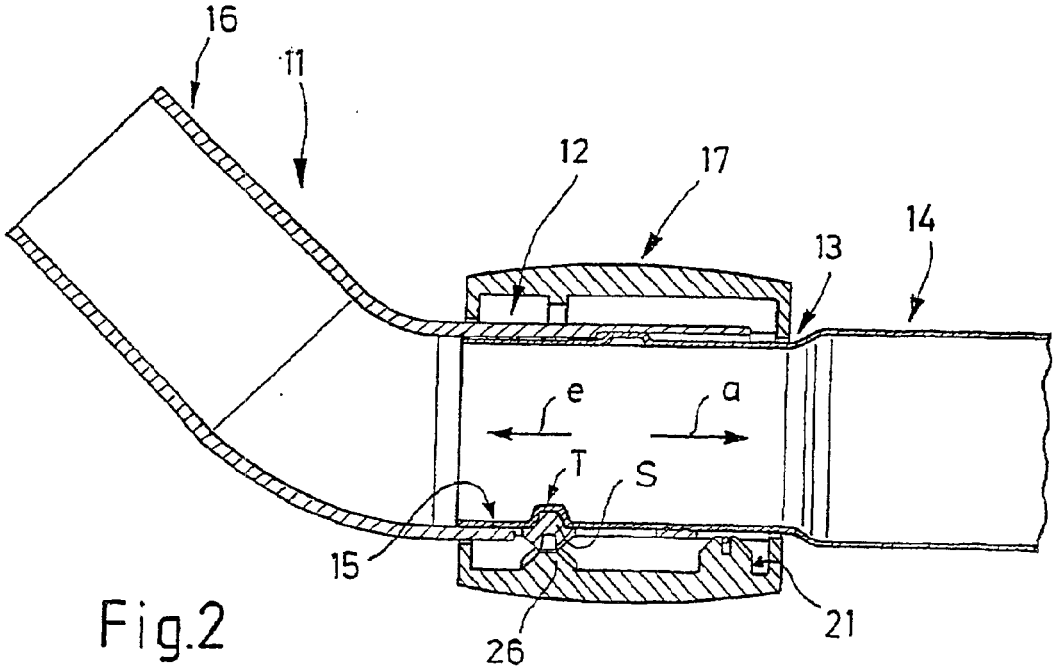

The vacuum cleaner hose arrangement capable of plug-in connection and designated in the drawing by the reference numeral 10 has a tubular nozzle fitting 11 with a socket part 12 as well as a plug-in end 13 of a vacuum cleaner pipe, for example, a telescoping inner pipe 14. Instead of the telescoping inner pipe 14, a telescoping outer pipe can be provided.

The pipe insertion end 13 is received by a socket receptacle 15 which is formed by the sleeve part 12. The insertion direction is shown by the arrow designated at e and the withdrawal or release direction is shown by the arrow designated at a.

An actuating slider configured as an actuating sleeve 17 is a slidable along both directions e and a in axial guide means not shown in greater detail, for example, by means of a groove and spline arrangement so as to be rotationally fixed on the outer periphery of the socket part 12.

The nozzle fitting 11 forms an end region 16 shown only schematically and which generally represents a vacuum cleaner tool like, for example, a suction nozzle, a suction brush or the like.

The nozzle fitting 11 is comprised in the illustrated embodiment of plastic and so is the sleeve part 12 connected unitarily therewith and the actuating sleeve 17 slidable on the sleeve part 12. The telescoping inner pipe 14 is comprised in the illustrated embodiment of steel. It will be self-understood that other workpiece selections that are sensible can be applied to the illustrated embodiment or the embodiments which may deviate according to the invention.

Figure 3:
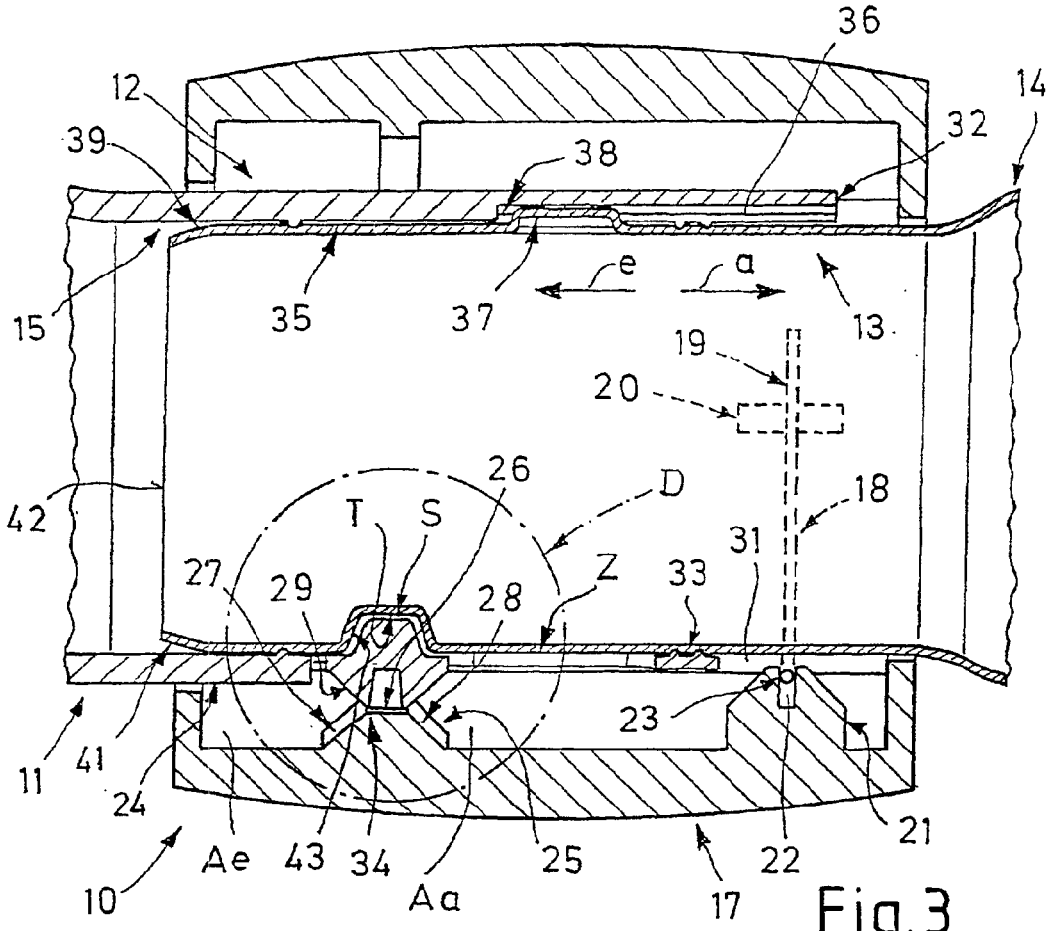
Figure 4:
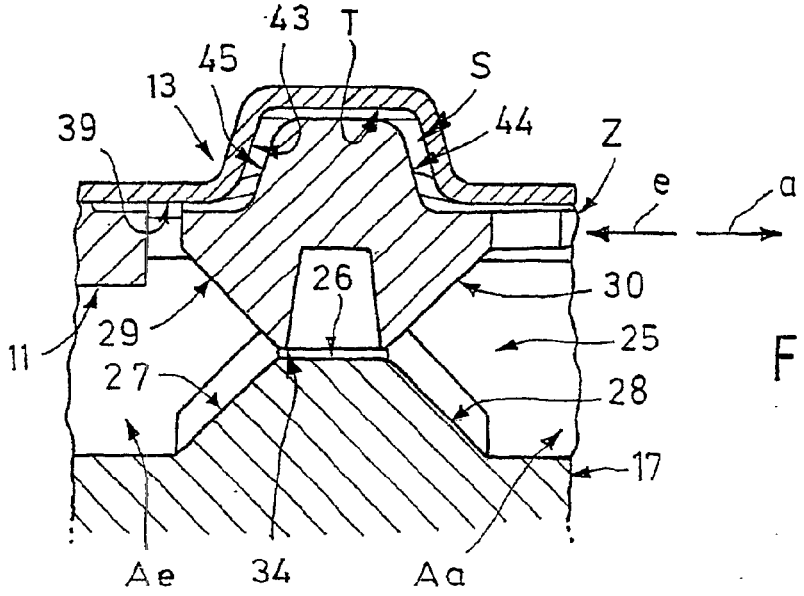

A ring-shaped bar spring 18 which surrounds the sleeve part 12 has both of its stressible ends 19 retained in support block 20 formed in the sleeve part 12. In FIG. 3 only one of the stressible ends 19 and a respective support block 20 has been illustrated in broken lines. The actuating sleeve 17 is formed with a somewhat claw-like formation 21 which projects inwardly somewhat radially toward the sleeve part 12; the claw opening 22 of the formation 21 receives the bar spring 16 which can be deflected in the spring region 23 in both opposing axial directions e and a.

To allow the spring region 23 to be deflected in the axial directions e and a, on the outer surface of the sleeve part 12 a movement space 31 is left.

The actuating sleeve 17 has a locking projection 25 which projects radially inwardly toward the outer surface 24 of the socket part 12 and which forms a locking surface 26.

In both axially opposite directions e and a, there are inclined lateral flanks of the blocking projection 25 forming sliding surfaces 27 and 28 for sliding counter surfaces 29 and 30 of a locking of the detent body represented as a whole at S.

The locking body B is an element of a tongue-like component designated as a whole with Z which is cut into the wall of the socket part 12 and which is provided with a tongue root with the reference numeral 33 disposed adjacent the end 32 of the socket part 12. The tongue-like component Z can, from the point of view of the material from which it is fabricated, be intrinsically resilient so that it will always seek to assume the position shown in FIG. 3.

The locking or detent body S has, as has ben shown for the locking projection 25, a somewhat frustopyramidal cross section. The locking or detent body B forms, corresponding to the locking surface 26 of the locking projection 25 an annular locking counter surface 34.

The inner shell surface 35 of the socket part 12 has, starting from its end 32 and opening inwardly therefrom, an axially extending slide-guide groove 36 which cooperates with an axial longitudinal corrugation 37 which extends toward the exterior somewhat like a spline.

An inwardly projecting abutment which is the same axial length as the slide guide groove 36 and is engageable by the short longitudinal corrugation 37 forms a tight-fitting snap locking engagement of the stop body S in a radially inwardly projecting cup-shaped detent recess T formed in the pipe insertion end 13. The cup-shaped detent cutout T or the cup-shaped recess has a generally frustoconically-shaped cross sectional contour.

The detent or stop body S engages in the cup-shaped detent recess T and has, corresponding to the cup-shaped detent recess, a corresponding cross sectional contour.

Because of its tongue connection the detent body S is guided substantially radially on the socket part 12 and with the latter at least is coupled for movement in the two opposite axial directions a and e.

The manner in which the illustrated plug connectable vacuum pipe arrangement 10 is actuated can be described as follows.

In the drawing the locking surface 26 of the locking projection 25 is found in its neutral axial position which is established by the rod spring 18 whose restoring spring force is effective in the directions a and e. In this neutral axial position, in which no spring restoring force of the rod spring 18 is acting upon the actuating sleeve 17, the locking surface 26 of the locking projection 25 is attained with the locking counter-surface 34 of the locking body S so that the latter is to be found in its locked position.

It is foreseeable that prior to the assembly of the device 10, the pipe insertion end 13 is located axially to the right ahead of the socket 15 and that the operator with one hand will insert it in the insertion direction e into the socket part 12 while the other hand of the operator holds fast the actuating sleeve 17. The conically tapering first control or directing surface 41 thus abuts against an inclined slide flank 44 of the frustoconically-shaped stop body S and shifts the latter relative to the actuating sleeve and that the socket part 12 coupled in movement with the stop body B in the direction e to the left.

The locking counter surface 34 of the locking body S slips out of contact with the locking surface 26 of the locking projection 25 while the latter is pressed by the first control or directing surface 41 into the receiving space Ae.

Thus the locking body S is unlocked and is finally aligned with the cup-shaped detent recess T as soon as the short longitudinal corrugation 37 abuts the stop 38 of the slide guide groove 36. The snap connection process is then completed by release by the operators hand of the actuating sleeve 17 which allows the spring-restoring force of the rod springs 18 to shift the sleeve part 12 in the insertion direction e.

While actuating sleeve 17 returns under the spring force in the direction e, the slide guide surface 27 of the locking projection 25 presses the locking body S which was still to be found in the take-up space Ae by means of its slide guide counter surface 30 into the cup-shaped detent recess T. Then the locking surface 26 lies against the locking counter surface 34.

The release of the arrangement 10 shown in the drawing functions as follows: with one hand of the operator gripping the actuating sleeve 17 and holding this fast and the other hand of the operator gripping the inner telescoping pipe 14, a pull is exerted on the pipe insertion end 13 in the direction a.

Thus the side flank 43 (the second directing or control surface) presses the neighboring end surface 42 of the pipe insertion end 13 from the left against the other inclined sliding flank 45 of the detent body S and thereby moves the detent body S together with the sleeve part movable therewith to the right in the direction a. As a result, the second control surface 43 presses the detent body S into the take-up space Aa. As a result, the detent body S is unlocked and the insertion end 13 can be completely withdrawn from the sleeve-like socket 15.

The aforedescribed functional description shows that both the assembly and release of the plug connection can be effected in a very comfortable manner.

What is claimed is:

1. A plug-connectable vacuum cleaner pipe arrangement comprising a sleeve part which forms a socket into which a pipe insertion end can be axially inserted in an insertion direction and which can be held in a snap-locked condition releasably by locking means which on a side of the sleeve part is comprised of a locking body movable on the sleeve part and on the side of the pipe insertion end is formed by a detent recess provided in the pipe insertion and in which a detent body releasably engages, an actuating slider is axially shiftable on the sleeve part and which has a locking surface and is displaceable in two axially opposite axial directions starting from a neutral axial position of the locking surface against respective spring restoring forces, the locking surface holding the locking body in a locked position in the neutral axial position of the locking surface and with each shift out of the neutral axial position being displaced into an unlocking position, an end of the pipe insertion end having a first control surface which upon insertion of the pipe insertion end into the socket moves the locking body together with the sleeve part relative to the locking surface in a pipe insertion direction, thereby unlocking the locking body and freeing it for releasable snap locking into the detent recess which is juxtaposed with a second control surface which, upon withdrawal of the pipe insertion end from the socket moves the locking body together with the sleeve part relative to the locking surface in a withdrawal direction and thereby disengages, the actuating slider having a radially inwardly projecting substantially claw-like formation extending toward the sleeve part with a claw opening receiving a rod spring held on the sleeve part at a spring region deflectable in both opposite axial directions.

2. A plug-connectable vacuum cleaner pipe arrangement comprising a sleeve part which forms a socket into which a pipe insertion end can be axially inserted in an insertion direction and which can be held in a snap-locked condition releasably by locking means which on a side of the sleeve part is comprised of a locking body movable on the sleeve part and on the side of the pipe insertion end is formed by a detent recess provided in the pipe insertion and in which a detent body releasably engages, an actuating slider is axially shiftable on the sleeve part and which has a locking surface and is displaceable in two axially opposite axial directions starting from a neutral axial position of the locking surface against respective spring restoring forces, the locking surface holding the locking body in a locked position in the neutral axial position of the locking surface and with each shift out of the neutral axial position being displaced into an unlocking position, an end of the pipe insertion end having a first control surface which upon insertion of the pipe insertion end into the socket moves the locking body together with the sleeve part relative to the locking surface in a pipe insertion direction, thereby unlocking the locking body and freeing it for releasable snap locking into the detent recess which is juxtaposed with a second control surface which, upon withdrawal of the pipe insertion end from the socket moves the locking body together with the sleeve part relative to the locking surface in a withdrawal direction and thereby disengages, the detent body being formed with a tongue like component cut out of the sleeve part and with a tongue root is adjacent an end of the sleeve part.

3. The plug-connectable vacuum cleaner pipe arrangement according to claim 2 wherein the actuating slider has a locking projection formed with the locking surface and projecting radially toward an outer surface of the sleeve part.

4. The plug-connectable vacuum cleaner pipe arrangement according to claim 3 wherein the locking projection radially tapers toward the sleeve part and has a frustopyramidal cross section, whereby roof surfaces of the locking projection form the locking surface and the locking surface is inclined in both opposite axial directions along side flanks forming slide guide surfaces for the locking body.

5. The plug connectable vacuum cleaner pipe arrangement according to claim 3 wherein the actuating slider forms a collar surrounding the sleeve part.

6. The plug connectable vacuum cleaner pipe according to claim 5 wherein the pipe insertion end has a radially outwardly projecting axial guide rib and the sleeve part has on an inner shell surface an axial guide groove corresponding to the axial guide rib.

7. The plug connectable vacuum cleaner pipe according to claim 6 wherein the detent recess is formed as a radially inwardly projecting cup-shaped recess oriented toward the pipe center.

8. The plug connectable vacuum cleaner pipe according to claim 7 wherein the cup shaped recess has a generally frustoconical cross sectional contour.

9. The plug connectable vacuum cleaner pipe according to claim 8 wherein the detent body forms a locking counter surface juxtaposed with the locking surface of the actuating slider.

10. The plug connectable vacuum cleaner pipe according to claim 8 wherein the detent body forms slide guide counter surfaces corresponding to the inclined slide guide surfaces of the locking projection of the actuating slider inclined in the two mutually opposite axial directions.

* * * * *